US006712007B2

(12) United States Patent
Yamamoto et al.

(10) Patent No.: US 6,712,007 B2
(45) Date of Patent: Mar. 30, 2004

(54) RAILWAY CAR

(75) Inventors: Takahisa Yamamoto, Yamaguchi (JP); Sumio Okuno, Yamaguchi (JP); Toshiaki Makino, Yamaguchi (JP); Yoshihiko Ina, Yamaguchi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/237,663

(22) Filed: Sep. 10, 2002

(65) Prior Publication Data

US 2004/0040463 A1 Mar. 4, 2004

(30) Foreign Application Priority Data

Sep. 2, 2002 (JP) ..... 2002-256603

(51) Int. Cl.[7] ..... B61D 15/06
(52) U.S. Cl. ..... 105/392.5
(58) Field of Search ..... 105/238.1, 396, 105/397, 402, 392.5

(56) References Cited

U.S. PATENT DOCUMENTS 5,579,699 A * 12/1996 Dannawi et al. ..... 105/416
5,715,757 A 2/1998 Dannawi et al.

FOREIGN PATENT DOCUMENTS

DE 195 17 918 11/1996
DE 196 38 739 4/1998
EP 0 802 100 10/1997
EP 0 990 815 4/2000

OTHER PUBLICATIONS

European Search Report completed Apr. 30, 2003, and Communication dated May 9, 2003, for EP App. No. EP 02 25 6233.

* cited by examiner

*Primary Examiner*—S. Joseph Morano
*Assistant Examiner*—Robert J. McCarry, Jr.
(74) *Attorney, Agent, or Firm*—Antonelli, Terry, Stout & Kraus, LLP

(57) ABSTRACT

A front end portion 100 is disposed on the front end of a car body. The floor thereof consists of extruded hollow members 210 that constitute a shock absorber 200. The shock absorber 200 is divided into an upper shock absorber 200 and a lower shock absorber 200. Annealed extruded hollow members are used to form the hollow member 210. The hollow members 210 are disposed so that their direction of extrusion corresponds to the longitudinal direction of the car body. The hollow members 210 are divided longitudinally into two portions by a plate 220. At the width-direction ends of member 210, the face plates 211 and 212 are welded onto plates 223–226. Upon receiving impact load, members 210 fold up into concertinas, absorbing the impact force. Since members 210 are separated by a plate, they deform evenly and continuously into concertinas instead of being bent in half, capable of absorbing a large energy.

16 Claims, 9 Drawing Sheets

Fig. 8
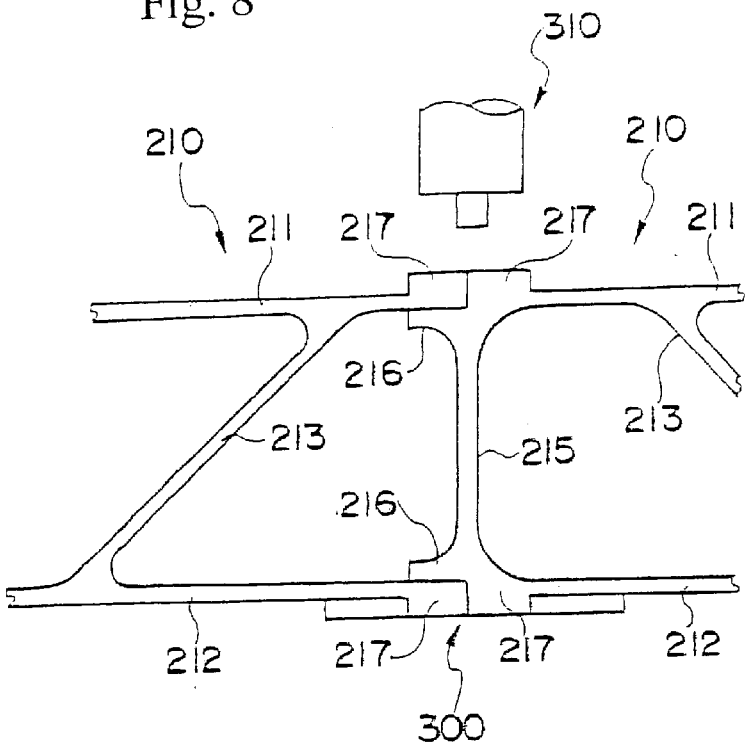
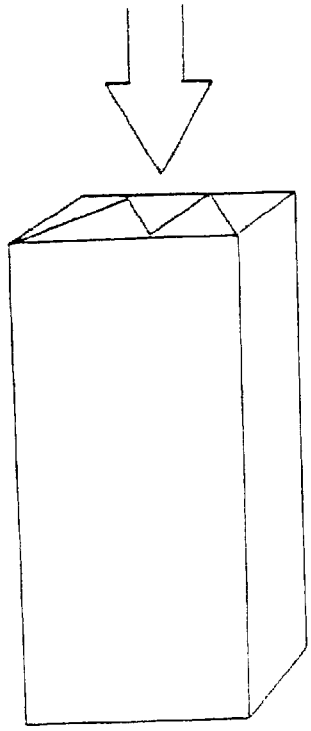
Fig. 9 (A)
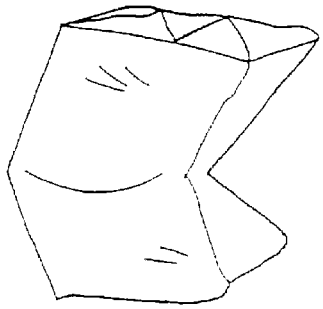
Fig. 9 (B)

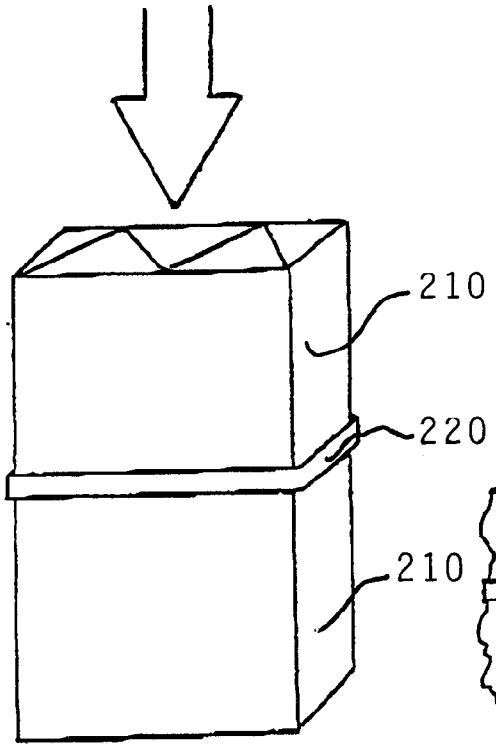
Fig. 10 (A)
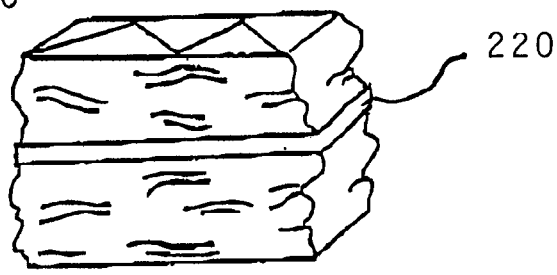
Fig. 10 (B)
Fig. 11
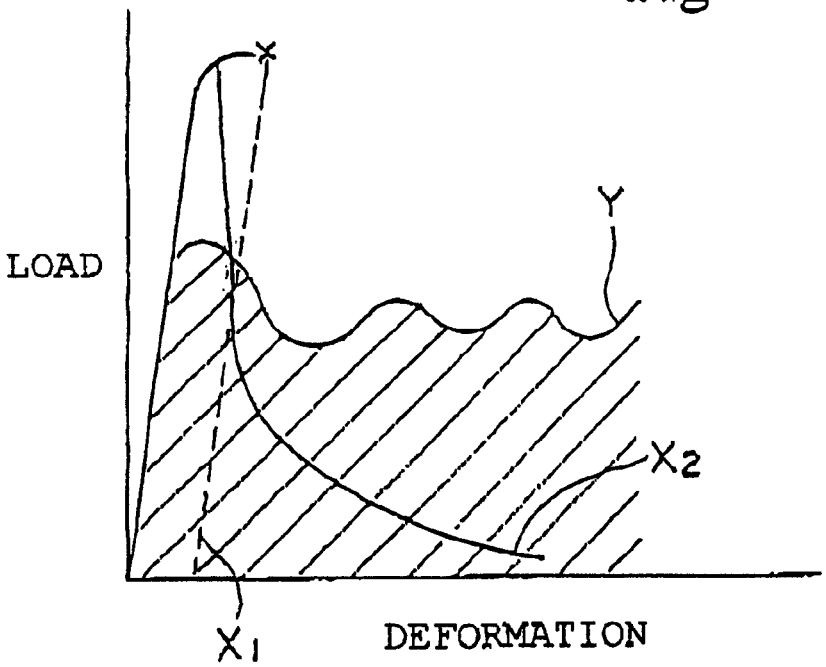

RAILWAY CAR

FIELD OF THE INVENTION

The present invention relates to a body of a railway car traveling on rails, preferably a railway car body composed of extruded hollow members made of light alloy.

DESCRIPTION OF THE RELATED ART

Upon designing a rail way car, the manufacturer must consider how to absorb and ease the impact force loaded to the passengers on board when collision occurs. Japanese Patent Laid-Open Provisional Publication No. H7-186951 (U.S. Pat. No. 5,715,757) discloses absorbing the energy generated by the impact of the collision loaded to the front end of the leading car by the deformation thereof. This shock absorber is composed of elements, honeycomb panels and the like that constitute triangular shapes within a plane perpendicular to the direction of impact. A plural number of relievers is positioned either in parallel relations to the direction of impact or linearly along the direction of impact.

A welding method called friction stir welding is proposed as a means to weld members, which can be applied to manufacturing railway cars. This method is taught in Japanese Patent No. 3014654 (EP 0797043 A2).

Japanese Patent Laid-Open Provisional Publication No. H11-51103 reports that by friction stir welding members, the metal constitution of the friction-stir-welded portion becomes refined, and the energy absorption capability is thereby improved.

According to the disclosure, friction stir welding is performed to the extruded hollow members made of aluminum alloy in either a ring-like or spiral-like manner, the welded member being utilized as the steering shaft of an automobile. Friction stir welding is performed in the direction perpendicular to the orientation of the impact energy, and the friction-stir-welded portion absorbs the impact force. Moreover, multiple short pipe-like members are arranged linearly along the direction of impact energy, and these members are friction-stir-welded to form a shaft.

The above-mentioned Japanese Patent Laid-Open Provisional Publication No. H7-186951 (U.S. Pat No. 5,715,757) proposes a shock reliever equipped to a railway car for absorbing the impact when collision occurs. This shock reliever is composed of multiple relieving devices, ensuring the safety of the passengers on board.

Since the shock reliever is provided to the railway car body, the length of the reliever should preferably be as short as possible so as to secure enough space for the passengers.

SUMMARY OF THE INVENTION

The present invention aims at providing a railway car that is capable of absorbing a large amount of impact energy.

The above object is realized by forming the members constituting the ends of the direction of travel of the car body with shock absorbers;

said shock absorber composed of plural extruded members having plural hollow portions disposed so that the direction of extrusion of the extruded members are arranged toward the longitudinal direction of the car body; and a partition plate is disposed in the longitudinal middle portion of the extruded members, enabling the extruded members to deform into concertinas (accordion-like form) when collision occurs.

BRIEF DESCRIPTION OF THE DRAWINGS

FIG. 8 is a view illustrating the joint of the extruded hollow members;

FIG. 9 is an explanatory view showing the shock absorber of the prior art;

FIG. 10 is an explanatory view showing the shock absorber of the present invention;

FIG 11 is an explanatory view showing the impact energy absorption of materials.

DETAILED DESCRIPTION OF THE PREFERRED EMBODIMENT

Figure 1:
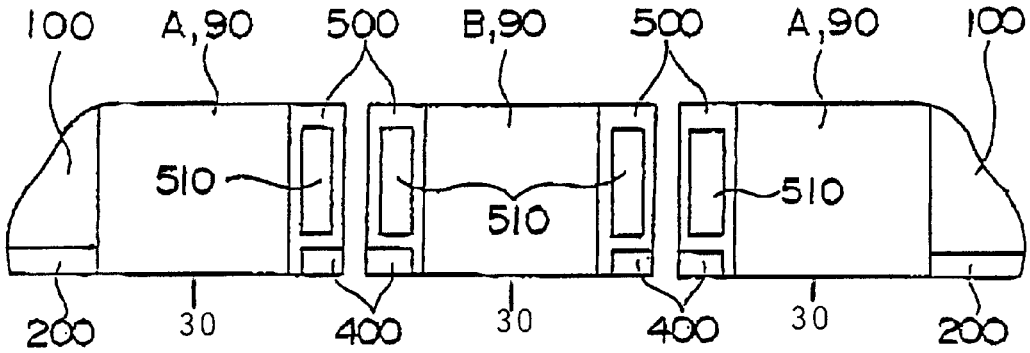
FIG. 1 is a side view showing the railway car formation according to one embodiment of the present invention.
Figure 2:
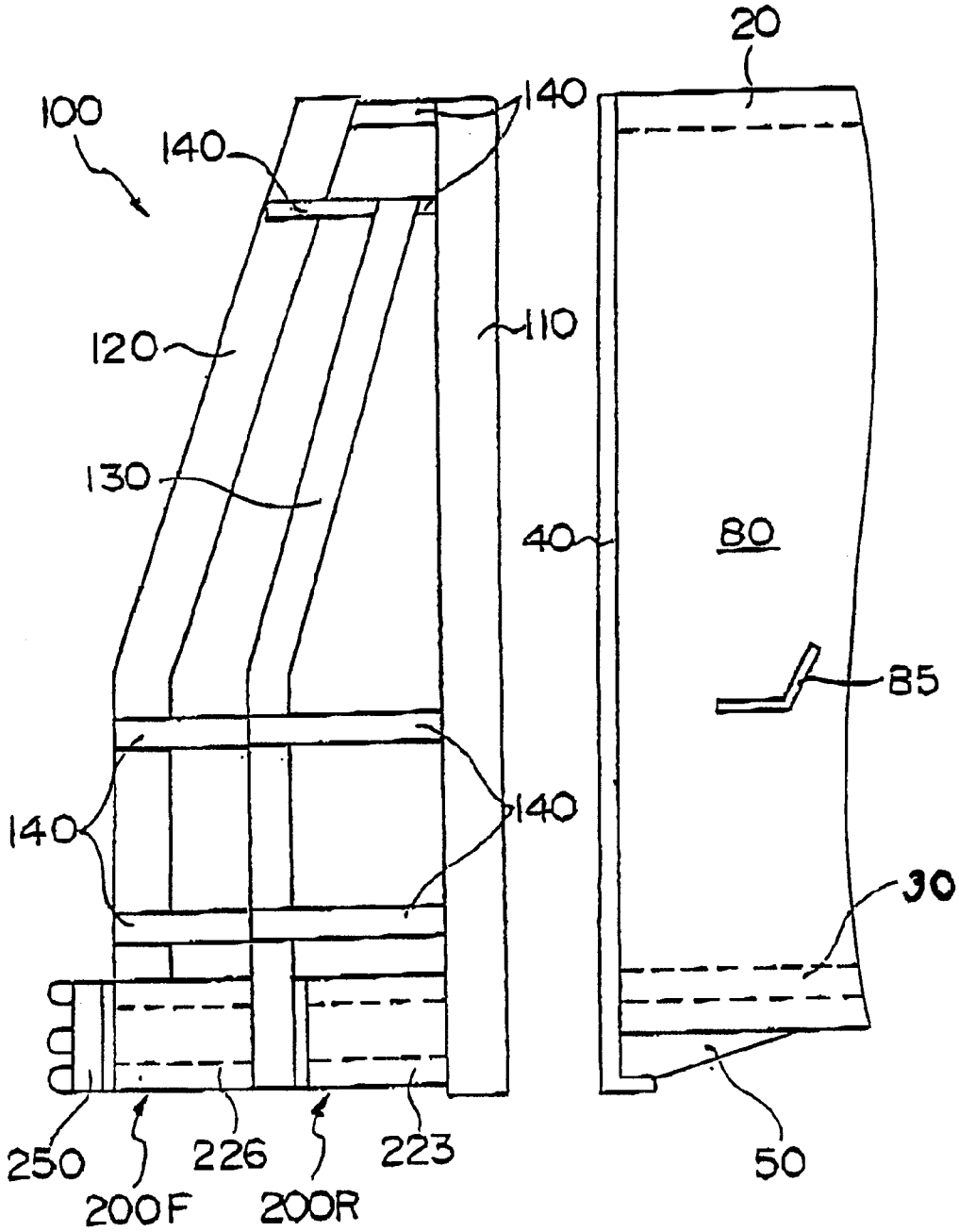
FIG. 2 is a side view showing the state in which the front end portion of FIG. 1 is separated.
Figure 3:
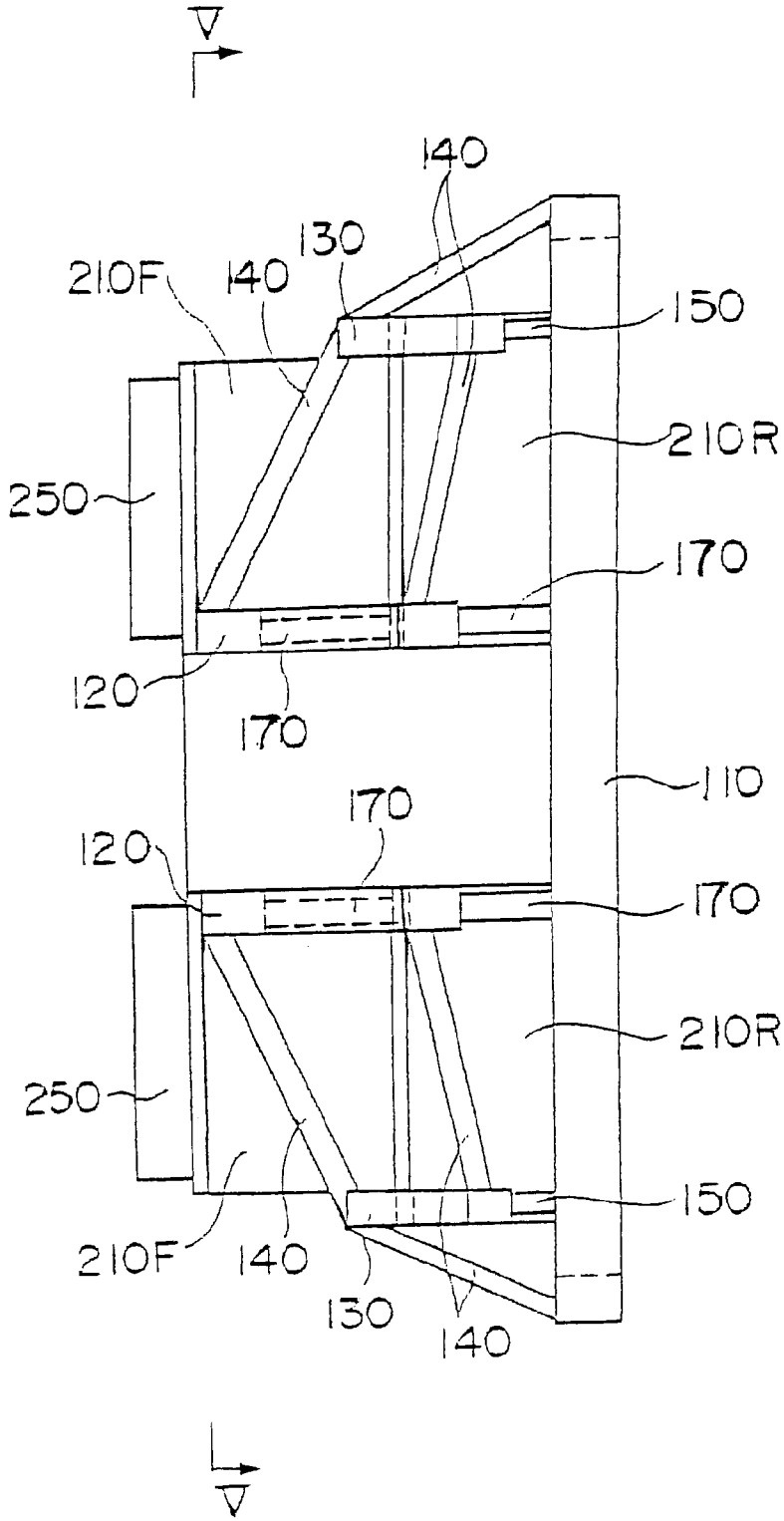
FIG. 3 is a plan view showing the front end portion of FIG. 2.
Figure 4:
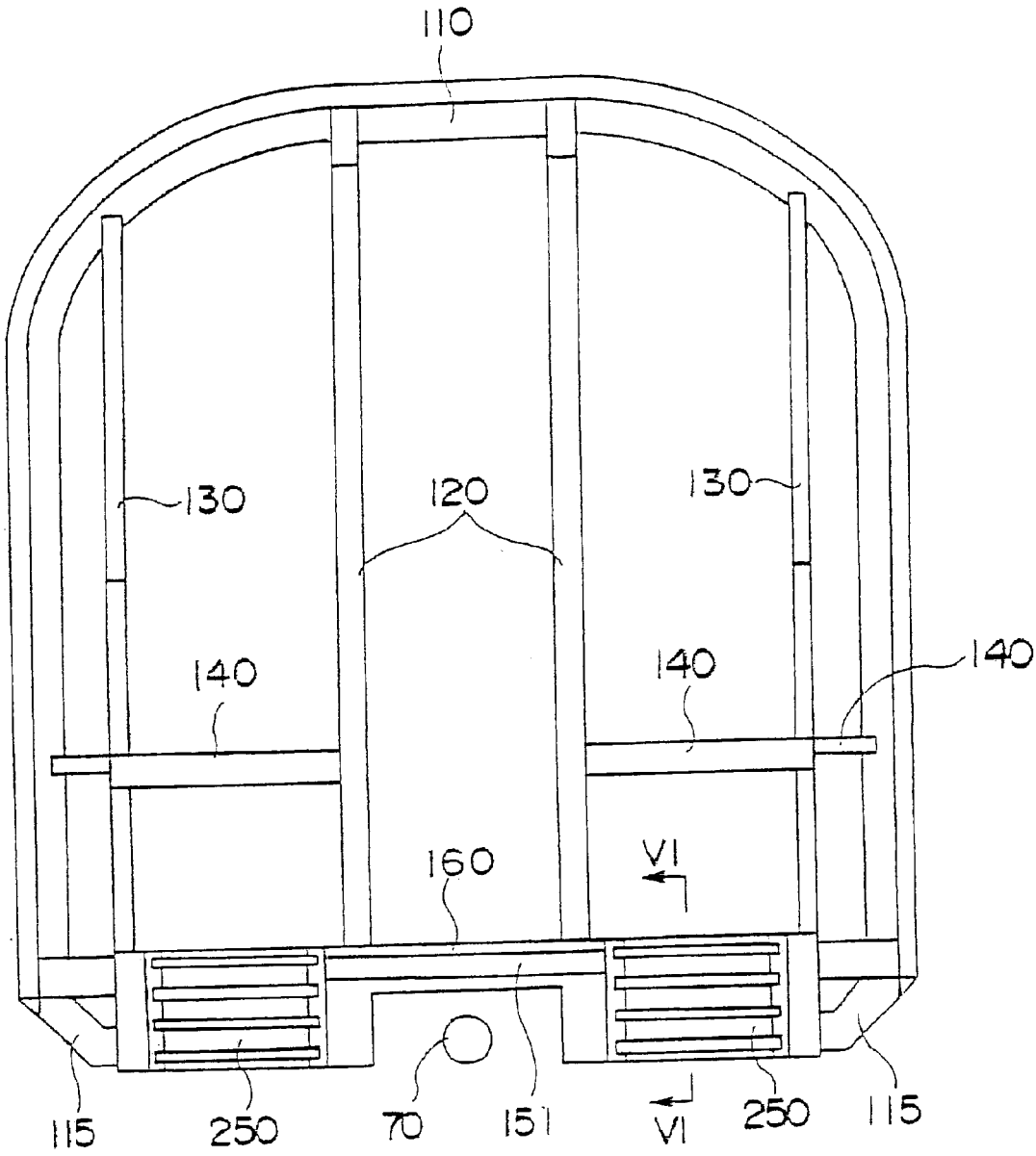
FIG. 4 is a left side view of FIG. 2.
Figure 5:
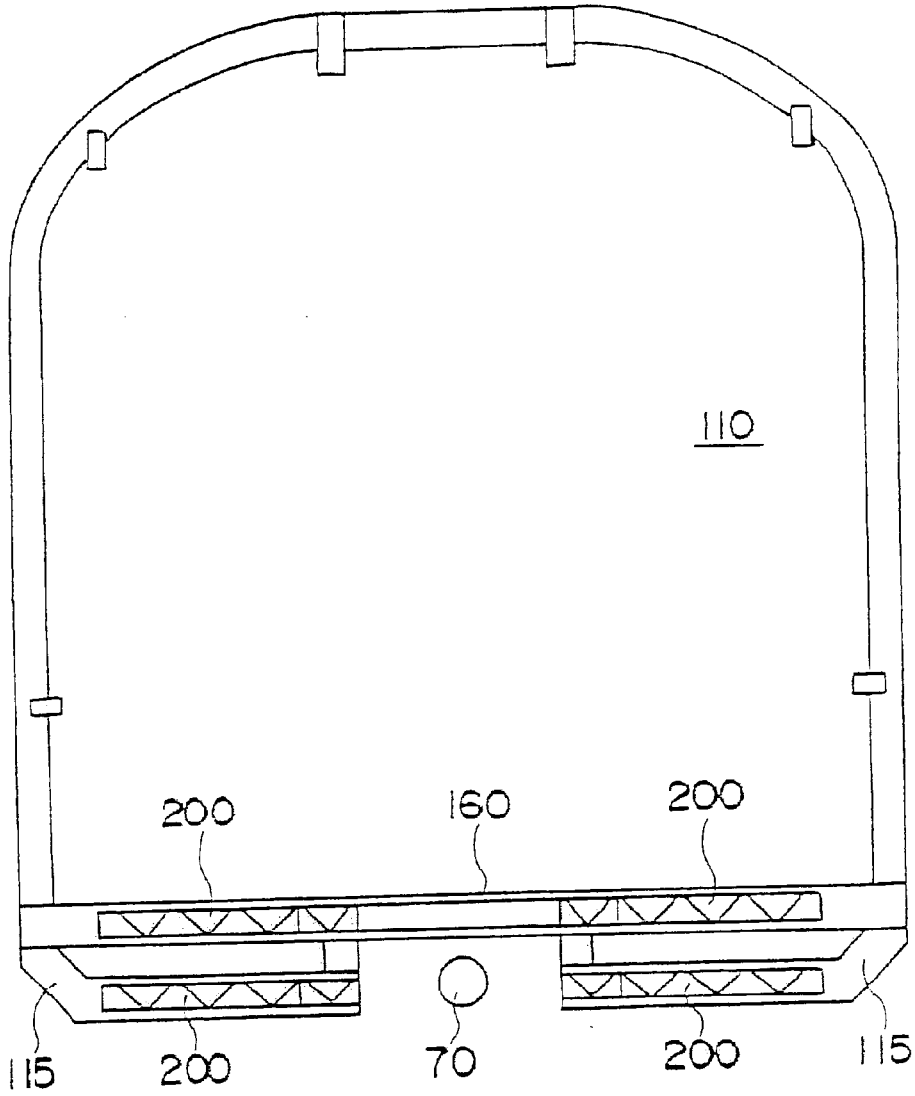
FIG. 5 is a V—V cross-sectional view of FIG. 3.
Figure 6:
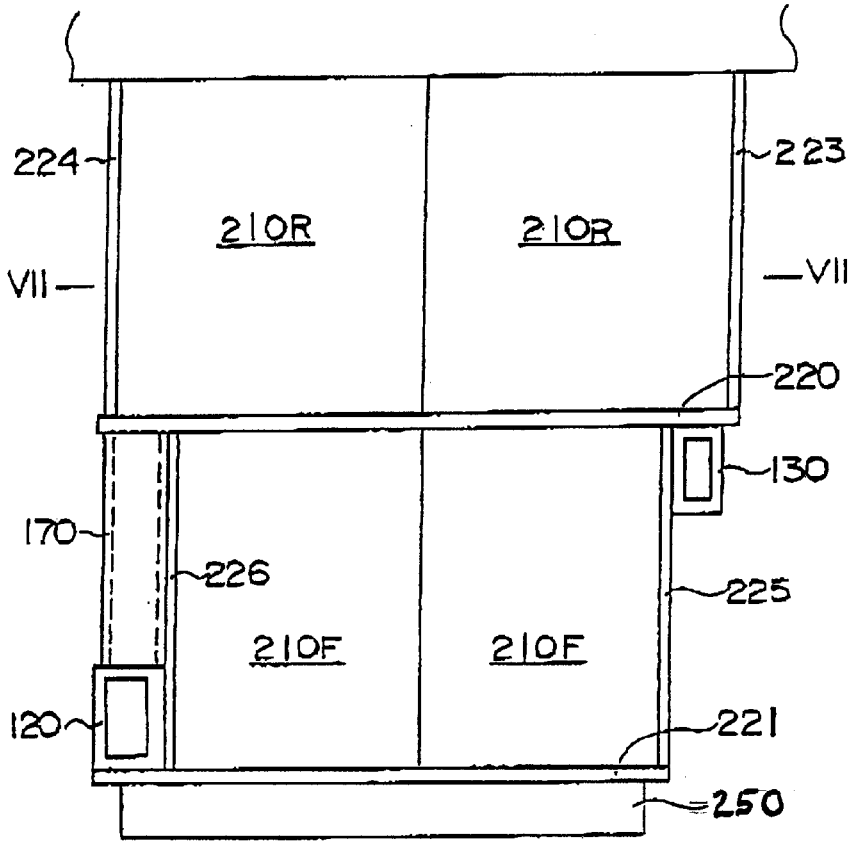
FIG. 6 is a plan view illustrating the right half of the shock absorber 200.
Figure 7:
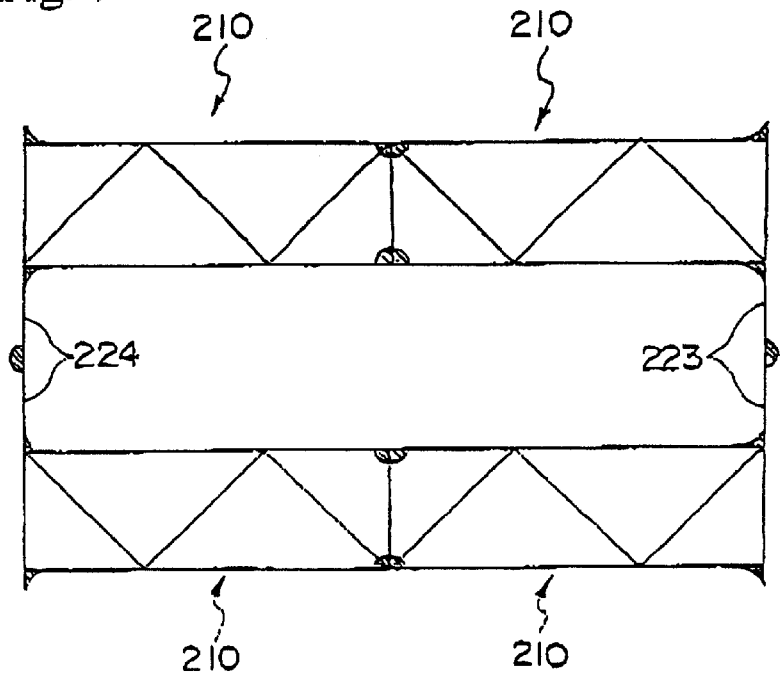
FIG. 7 is a VII—VII cross-sectional view of FIG. 6.

A preferred embodiment of the present invention will now be explained with reference to FIGS. 1 through 12. In order to facilitate easier understanding, FIG. 1 illustrates a view where each car body is separated, and FIG. 2 illustrates a view where the car body and its front end portion are separated. In FIGS. 9 and 10, (A) illustrates the shape before compression, and (B) illustrates the shape after compression in frame formats. In FIGS. 5, 7, 9 and 10, the numbers of trusses of the extruded hollow members do not correspond.

The present car formation is composed of two leading cars A that are disposed at the front and back ends of the car formation, and middle cars B of necessary numbers (in the drawing, only one middle car is illustrated). The front end portion 100 of the leading car A is curved and projected in an arc-like shape toward the forward direction. A shock absorber 200 is disposed to the front end portion 100. Further, shock absorbers 400, 400 are disposed to the rear end of the leading car A and to the front and rear ends of the middle car B. First, the shock absorber 200 disposed to the front end portion 100 will be explained in detail.

A car body 90 excluding the front end portion 100 is composed of side constructions 10 that constitute the side walls of the car body, a roof construction 20, an underframe 30 that constitutes the floor thereof, and so on. The side constructions 10, the roof construction 20 and the underframe 30 are all formed by welding plural hollow members together. Each hollow member is an extruded member made of light alloy (such as aluminum alloy), the extruded hollow members being disposed so that their direction of extrusion (that is, the longitudinal direction) is oriented parallel to the longitudinal direction of the car body. Plural extruded hollow members are arranged side by side in the width direction along the circumference direction of the car body, and the members are welded together to form a single structure. At the end of the car body 90 is provided a seat 40 for fixing the front end portion 100. The space 80 provided at the forward end of the car body 90 is the driver's cab, and a driver's seat 85 is disposed on the floor formed above the underframe 30.

The front end portion 100 comprises a frame 110 that allows the portion 100 to be locked onto the car body, plural pillars 120, 130, plural cross beams 140, a shock absorber 200, an anticlimber 250, and so on. The frame 110 has four sides, the upper side being curved into a U-shape. The frame 110 is removably fixed to the seat 40 of the car body 90 by bolts. The pillars 120 connect the upper end of the frame 110 and the front end of the shock absorber 200. The pillars 120 are located near the center of the car body when seen from the front of the body. The pillars 120 are disposed on both sides of a coupler 70. The pillars 130 connect the upper portion of the frame 110 and the sides of the shock absorber 200. The pillars 130 are disposed at the longitudinal center portion of the shock absorber 200, and are connected to the side walls of the car body. Since the pillars 120 are likely to collide against obstacles, they are designed to be thicker and stronger than the pillars 130. The cross beams 140 are disposed at the upper end and the center of height of the frame 110, and connect the frame 110 and the pillars 130 and 120. The areas of connection are welded together. The area defined by the frame 110, the pillars 120, the pillars 130 and the cross beams 140 is covered smoothly by metal plates and glass (not shown in the drawing).

The rear end of the shock absorber 200 is abutted against and welded onto the lower edge of the frame 110. The shock absorber 200 is composed of two layers, an upper layer and a lower layer. The lower portion of the shock absorber 200 is welded onto a seat 115 arrange in parallel therewith at a position below the bottom side of the frame 110. The seat 115 is welded onto the bottom side of the frame 110.

The side constructions 10, the roof construction 20 and the underframe 30 are made by welding together plural hollow extruded members made of light alloy (such as aluminum alloy) Especially, the underframe 30 is formed firmly. The bottom side of the seat 40 has the same configuration as the seat 115. The back surface of the seat 40 and the bottom surface of the underframe 30 are connected strongly by plural stays 50.

The upper shock absorber 200 is opposed to the seat 40 of the underframe 30 through the bottom side of the frame 110. The lower shock absorber 200 is opposed to the lower portion of the seat 40 of the underframe 30 through the seat 115.

The front end of the upper and lower shock absorbers 200, 200 is welded onto an anticlimber 250. The front end of the anticlimber 250 has projections and recesses, preventing the obstacle that collides against the body from moving upward. A rubber shock absorbing unit (not shown) is mounted between the front end of the anticlimber 250 and the shock absorbers 200, 200.

The shock absorber 200 is not only designed to have two (upper and lower) layers, but is also divided into left and right portions when observed from the front of the car body. In other words, the shock absorber 200 is composed of four parts. The space between the left and right shock absorbers 200, 200 of the lower layer is utilized as the space through which the coupler 70 of the car passes. The upper shock absorbers 200, 200 also have a space formed therebetween, the upper area of which having disposed a plate member 160 that is used as the floor for mounting equipments. The plate 160 is fixed to the upper shock absorbers 200, 200. Further, the plate 160 is mounted on a support seat 151 fixed to the upper shock absorbers 200, 200. There are plural support seats 151 disposed along the longitudinal direction of the car body at predetermined intervals. The plate 160 can cover the whole surface of the shock absorbers 200, 200.

Moreover, it is also possible to provide a shock absorber between the two upper layer shock absorbers 200, 200, and integrate the same with the left and right shock absorbers 200, 200 to form a single body. In this case, there is no need to provide the plate 160 and support seats 151. Moreover, the anticlimber 250 can be mounted on the front end side of the additional shock absorber 200.

The shock absorber 200 comprises a hollow extruded member 210 made of light alloy (such as aluminum alloy). The extruded hollow member 210 is arranged so that the direction of extrusion thereof is arranged along the direction of travel (the longitudinal direction) of the car body. The hollow portion is oriented parallel to the longitudinal direction. Plural extruded hollow members 210, 210 are arranged side by side along the width direction of the car body. The width-direction-ends of the adjacent extruded hollow members 210, 210 are welded together.

The hollow member 210 comprises two face plates 211 and 212 which are disposed substantially parallel to each other, plural connecting plates 213 connecting the two face plates and being slanted against the two face plates 211 and 212, and a connecting plate 215 substantially orthogonal to and disposed at the width-direction end of the face plates 211 and 212. The face plates 211, 212 and the connecting plates 213 are arranged in trusses. At the joint area, the connecting plate 215 is disposed to only one of the two hollow members to be joined together.

The hollow members 210, 210 are welded together by friction stir welding. The welding direction is parallel to the longitudinal direction of the hollow member 210 (the longitudinal direction of the car body). Segments 216 protrude toward the end side at the joints between the face plate 211 (212) and the connecting plate 215. The ends of the connecting plate 215 are recessed from the outer surface of the face plates 211, 212. The projecting segments 216 are formed to this recessed portion, respectively. The face plates 211 and 212 of the adjacent hollow member 210 are superposed with the recessed portions. The face plates 211 and 212 of one hollow member are abutted against the corresponding face plates of the adjacent hollow member, respectively. The end surface of the face plates 211, 212 of the hollow member 210 where the connecting plate 215 is formed (the surface including the recessed portion) is substantially disposed on the extension of the center of plate thickness of the connecting plate 215. The outer surface on the ends of face plates 211 and 212 being abutted against the adjacent hollow member are provided with projections 217 that protrude out along the thickness direction of the hollow member. The projections 217 on the two adjacent hollow members are also abutted against one another.

Friction stir welding will now be explained. One pair of hollow extruded members 210, 210 is mounted on a bed 300. The lower projections 217, 217 of the members are mounted on the bed 300. The butt joint is temporarily welded by arc welding along the longitudinal direction thereof. The upper abutted portion is friction-stir-welded using a rotary tool 310. The lower end of a large-diameter portion of the rotary tool 310 is disposed between the outer surface of the face plate 211 (212) and the upper surface of the projections 217, 217. The remaining projection can be removed if necessary by cutting. After friction-stir-welding the upper portion, the hollow members 210, 210 are turned upside down, and friction stir welding is performed to the opposite side in a similar manner. The projections 217 can be omitted.

The hollow member 210 is, for example, a member constituting the underframe 30. One or more hollow members are welded so that the resulting member equals the necessary width of the shock absorber 200 (the width direction of the carbody). If necessary, the width of the hollow member can be cut off. It is desirable that the with-direction of the shock absorber 200 is flat, so the hollow members for constituting the underframe 30 are preferred. However, the side sills of the underframe 30 will not be used. Further, the side constructions 10 also include linear hollow members, which can also be used as the present shock absorber. The cost of the present shock absorber is inexpensive since the hollow extruded members utilized to form necessary parts of the car body can be appropriated as the shock absorber member.

There are a total of four shock absorbers 200, two on each sides (left and right), each side having one absorber disposed above the other. Each shock absorber 200 is composed of two front hollow members 210F, 210F and two rear hollow members 210R, 210R. The width of the front hollow members 210F, 210F in the horizontal direction are smaller than the width of the rear hollow members 210R, 210R in the horizontal direction. The joint between the front hollow members 210F and 210F and the joint between the rear hollow members 210R and 210R are disposed at the same position in a horizontal plane. The face plates 211, 212 and the connecting plates 213, 215 of one hollow member 210 are disposed along the line of extension of the face plates 211, 212 and the connecting plates 213, 215 of the other hollow member 210. The front hollow members 210F, 210F and the rear hollow members 210R, 210R are separated by a plate 220.

On the front end of the front hollow members 210F, 210F is disposed a plate 221 fixed to the members by fillet welding. The plate 221 functions to transmit the collision load evenly to the hollow members 210F, 210F. The plate 221 also functions as a seat for mounting the anticlimber 250.

The plate 220 is somewhat larger than the outer shape of the hollow members 210F, 210F, 210R and 210R when observed from the longitudinal direction of the hollow members 210F, 210R. The ends of the hollow members 210F, 210F, 210R and 210R are fixed to the plate 220 by fillet welding.

Furthermore, the left and right width-direction ends the two face plates 211 and 212 of two hollow members 210F and 21OF (210R and 210R) being friction-stir-welded to each other are fixed to plates 223 and 224 or 225 and 226, respectively, by fillet welding. The plates 223 through 226 are somewhat larger than the outer shape of the hollow members 210F and 210R when observed from the width direction of the hollow members. The connecting plates 213 disposed at the width-direction ends of the two welded hollow members can also be fillet welded to the plates 220 and 223.

Though the shock absorber 200, 200 is divided into upper and lower layers, the plates 220, 221, 223 through 226 are not divided into two layers, and their height covers the upper and lower layers of the shock absorber. The height of the plates 220, 221, 223 through 226 is designed to further include the space provided between the upper and lower layers of the shock absorber 200, 200. There is no need for the fillet welding performed to the plates 200, 221, 223 through 226 to cover the whole contact area between the hollow shape members 210. The fillet welding may simply be performed to the areas where the welding electrodes can reach.

According to another example, the plates 220, 221, 223 through 226 can be divided into two parts, an upper plate and a lower plate, respectively. According to this example, the upper hollow members 210F and 210R can be fillet welded to the upper plate 220. The same can be said for the plate 221. Next, the bottom end of the upper plates 220 and 221 can be abutted against the upper end of the lower plates 220 and 221, and butt welding can be performed thereto. Next, the side plates 223 through 226 can be welded together. The ends of the plates 223 through 226 in the longitudinal direction of the car body are abutted against the face of the plate 220. These ends can be fillet-welded to the plate.

The lower end of the pillar 130 is welded onto the vertical surface of the plate 220. The lower end of the pillar 120 is welded onto the plate 220 through a stay 170 disposed along the longitudinal direction of the car body.

The plates 220, 221, 223 through 226 and the hollow member 210 are welded together by MIG welding. The welding can either be continuous or intermittent. In either example, the welding should be performed sufficiently so that no cracks occur to the welding portion when the load caused by collision is received.

The size of each member will now be explained. The length of the front hollow member 210F in the direction of extrusion is approx. 600 mm, the length of the rear hollow member 210R in the direction of extrusion is approx. 400 mm, the width of each hollow member 200 is approx. 400 mm, the thickness is approx. 60 mm, and the thickness of the face plates 211, 212 and the connecting plates 213, 215 is approx. 2.5 to 3.2 mm. Further, the thickness of plates 220 and 221 is approx. 12 mm, and the thickness of plates 223 through 226 is approx. 6 mm.

According to such construction, when the car body collides against an obstacle or an adjacent car body, the shock absorber 200 collapses (buckles) in the longitudinal direction, and thereby absorbs the impact energy.

The extruded hollow member 210 constituting the shock absorber 200 is softer than the extruded hollow members constituting the underframe 30, the side constructions 10 and the roof construction 20, and can easily collapse during collision, thereby absorbing the energy of the impact. The soft hollow member 210 is formed by annealing and softening the hollow member used to create the underframe 30.

The annealing process can adopt a method called an O-material treatment, for example. This annealing treatment is performed so that the material obtains similar properties as a non-heat-treated material. In general, various heat treatments are performed to the extruded members after extrusion. If the material of the extruded member is A6N01, an artificial aging and hardening process according to T5 is performed. The O-material annealing treatment is performed thereafter. The O-material annealing treatment is performed for two hours at 380° C., and the yield stress is 36.8 MPa. The yield stress of T5 is 245 MPa. The O-material annealing treatment is meant to soften the material forming the extruded hollow member. The elongation of the hollow member 210 is greater than that of the general hollow member. The yield stress of the hollow member 210 is smaller than that of the general hollow member. In order to provide necessary strength and softness to the member, annealing treatments other than the O-material treatment can also be performed. Further, the plate thickness of the hollow member can also be chosen to provide the best performance.

The object of providing the plate 220 to the shock absorber will now be explained. For example, if the shock absorber is not equipped with the plate 220 but rather composed of a one continuous extruded hollow member 210, the hollow member 210 will be buckled into a transverse "V" shape (bent at the middle) as shown in FIG.

9when impact load is received. Only very small energy can be absorbed if the hollow member 210 collapses into a V-shape. Therefore, the separating plate 220 is provided in the middle of the extruded hollow members in order to prevent the hollow members from buckling at this portion. According to this construction, the extruded hollow members is prevented from being bent in the middle, but rather, the extruded hollow members in the front and rear of the plate 220 are buckled in small portions continuously into concertinas form, thereby absorbing a large energy, as illustrated in FIG. 10. For example, the length of one extruded hollow member 210 in the longitudinal direction should desirably be approximately 600 mm or less. If the member is approximately 600 mm or less, the impact load will cause small continuous buckling to be formed to the member, and thus the member is capable of absorbing large impact energy.

Moreover, the width-direction ends of the face plates 211 and 212 of the extruded hollow members 210 are welded onto the plates 223 through 226. If there were no plates 223 through 226, the ends of the face plates 211 and 212 of the members 210 would become free ends, unable to contribute to the action of the shock absorber absorbing the energy. However, if the ends of the face plates are constrained by being welded onto the plates 223 through 226, the ends of the face plates also fold up into concertinas, absorbing the energy.

In the underframe 30, side sills (not shown) are provided to both width-direction-ends of the car body. The side sills are large, firm extruded hollow members. The front end portion 100 does not have extruded hollow members corresponding to the size of side sills. Further, the front end portion 100 does not have members with strengths corresponding to that of the extruded hollow members constituting the side sills of the underframe 30. Members (not shown) for connecting the coupler 70 are equipped to the lower surface of the underframe 30. However, the front end portion 100 is not equipped with such member. These members are equipped along both the longitudinal direction and the width direction of the car body. These members and the hollow members constituting the side sills are firm against the compressive load acting parallel to the longitudinal direction of the car body. Moreover, there is also a member for supporting the coupler 70.

When the railway car collides against an obstacle, impact load occurs. When the coupler 70 collides against an obstacle, the impact causes the coupler 70 to drop off from the car, and causes the shock absorber 200 to exert its shock absorbing function. When the anticlimber 250 collides against an obstacle, the collision impact acts on the hollow members 210 constituting the shock absorbers 200, 200.

Since the extruded hollow members 210 are soft, they deform when impact is received and thus the impact is relieved, before the underframe is deformed by the impact. Therefore, the safety of the passengers is ensured. The impact causes the length of each hollow member 210 to shrink to about half to one-third its original length. At such time, it is necessary that the equipments located at the space above the hollow members 210 are prevented from crashing into the driver's cab and harming the driver. This is realized for example by appropriately designing the location and size of the equipments. Moreover, a partition wall for separating the equipments and the driver's cab 80 can be mounted to the frame 110, the upper shock absorbers 200, 200 and the plate 150, so as to further ensure the safety of the driver. The partition wall can be formed using the boxes enclosing the equipments. The partition wall can be equipped to the seat 40 and the underframe 30. Moreover, the driver's seat 85 can be set to a position where it is clear of the path of any equipment that may crash into the driver's cabin by collision. According to another example, sufficient space is provided between the seat 85 and the equipment that may crash into the cabin.

Figure 12:
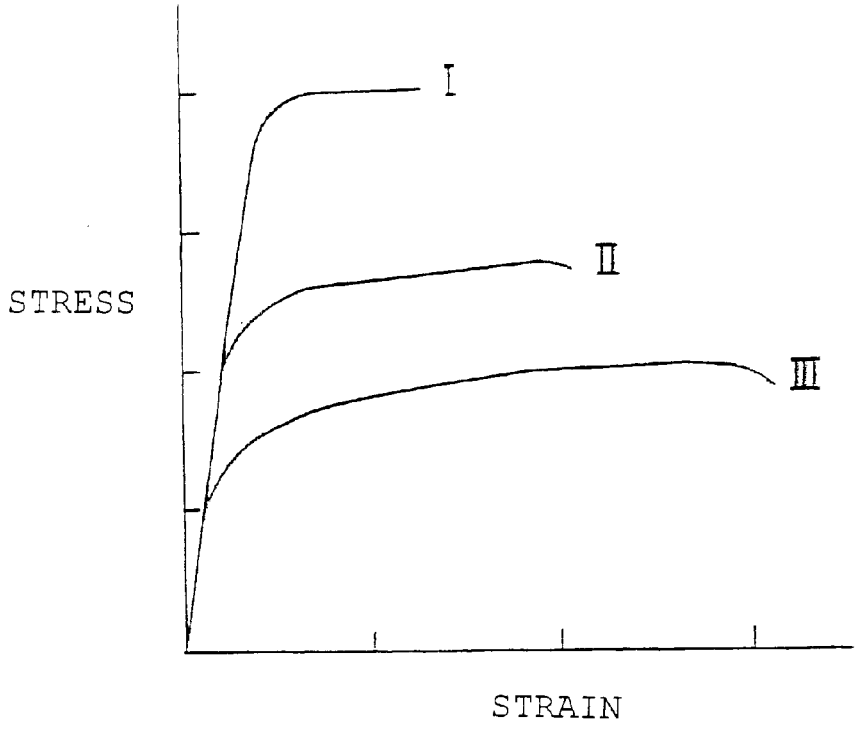
FIG. 12 is a stress-strain diagram of the materials.

We will now explain the impact-relieving characteristics of the hollow member 120. When compressive load is applied, the hollow member presents a load-deformation behavior as illustrated in FIG. 11. Three types of material can be considered having different material characteristics as illustrated in FIG. 12, which are, a material I having high strength (such as tensile strength and yield strength) and small elongation (brittle); a material III having less strength but better elongation; and a material II having a property intermediate those of materials I and III. The material shown by the curve X ($X_1$, $X_2$) of FIG. 11 (the material corresponding to strength property I of FIG. 12) has better withstand load, but the withstand load drops significantly when the maximum load is exceeded. On the other hand, according to the material having low strength and high elongation (the material corresponding to strength property III of FIG. 12), the maximum withstand load is smaller but the withstand load does not drop significantly, as shown by the curved line Y of FIG. 11.

The shaded area shown in FIG. 11 corresponding to curved line Y indicates the fracture energy of this material. When curve X is compared with curve Y, the material having less strength but better elongation (in this case, the material of curved line Y) has higher fracture energy, considering the deformation behavior that curve X shows after exceeding the maximum withstand load. It is important to select a material having such strength characteristics Y as shock absorbing member. A material having the Y-curve property can be obtained easily by providing an O-material treatment to an extruded member, for example.

In the case of curved line X, since the material has high strength and small elongation, the elongation of the member cannot correspond to the imbalance of the stress within the cross-section of the member, causing partial breaking thereof, thus causing the withstand load to drop rapidly. On the other hand, in the case of curved line Y, the maximum withstand load of the member is lower than that of curve X, but since the material has greater elongation, partial plastic deformation of the material (elongation of the member) occurs corresponding to the dispersed stress within the cross-section of the material, preventing the overall withstand load from dropping significantly. According to these characteristics, the material can deform greatly while maintaining a certain level of withstand load.

Accordingly, the hollow members 210, 210 are buckled continuously into the shape of concertinas (accordion-like form), relieving the shock loaded to the car body. Moreover, since the members are formed as hollow members, in comparison to the general thin-plate structure, each member has better in-plane and outer surface (direction perpendicular to in-plane) flexural rigidity, and since each hollow member comprises a composite structure including two face plates and cross (oblique) plates, it has higher breaking-energy absorption property against compressive load (per unit planar area).

Moreover, curve Y corresponds to the case where the plate 220 divides the hollow members 210 longitudinally. Curve X corresponds to the case where no partition plate 220 is provided to the hollow members.

It is discovered that by providing a partition plate 220 to the hollow members, the absorption energy is increased.

Moreover, it is desirable that the length of the hollow member 210 constituting the front shock absorber 200F is longer than the length of the hollow member 210 of the rear shock absorber 200R, and the cross-sectional area of the front hollow member 210 (comprising the face plates 211, 212 and the connecting plates 213, 215) is smaller than the cross-sectional area of the rear hollow member 210 (comprising the same). According to this design, the front shock absorber 200F starts to collapse first.

Plural extruded hollow members 210, 210 are welded together by performing friction stir welding along the longitudinal direction of the car body corresponding to the direction of the impact. If the welding is performed by arc welding, the welded area may break by the impact and the members will not deform into concertinas, and the energy absorption characteristics is deteriorated. This is because according to arc welding, the impact value of the welded area is greatly reduced compared to the impact value of the base material. On the other hand, the impact value of the friction-stir-welded area is improved compared to the arc-welded portion, and the joint will not break when impact force is received. The reason for this is considered to be that the metal constitution of the joint is refined by the friction stir welding, and the energy absorption value is thereby improved. Therefore, when the hollow members are welded by friction stir welding, each member deforms in the desired manner, effectively absorbing the impact energy.

Since the shock absorber 200 is divided into upper and lower layers, the impact energy can be effectively absorbed by utilizing existing hollow members as shock absorbers.

The lower end of pillars 120 and 130 are welded onto the hollow members 210, 210. Thus, the impact force is effectively transmitted from the pillars 120 and 130 colliding against an obstacle to the hollow members 210, 210. Further, the pillars 120 and 130 are welded onto the shock absorber 200 at locations where they will not hold back the deformation of the shock absorber 200.

According to the above-mentioned embodiment, friction stir welding is performed from both faces of the hollow members, but it is also possible to weld the bottom face plates of abutted members from the upper face plate side of the members, and then to weld the upper face plates with a connecting material disposed in between, as illustrated in FIG. 9 of the above-mentioned Japanese Patent No. 3014654 (EP 0797043 A2).

Now, the shock absorbers 400 disposed at the rear end of the leading car A and the ends of middle cars B will be explained. Each shock absorber 400 has a similar composition as the shock absorber 200. A plate and a support seat is disposed between and on top of the left and right shock absorbers 200, 200 (400, 400), constituting the floor of the passage for the crew and the like. An anticlimber 250 is disposed on the front end of the shock absorber 400. When a shock absorber 400 is disposed also between the left and right shock absorbers 400, 400, the anticlimber 250 is mounted to the front end of this shock absorber 400.

The area above the shock absorbers 400 and the seat can be used as a space where an entrance 510 to the car body is provided. This area can also be used as a space for locating the switch board (control panel). Moreover, it can be used as a space where no passenger seats are disposed. Such use of the upper area of the absorbers 400 allows damage to the passengers to be minimized during collision.

The end portion 500 comprising the shock absorbers 400 is removably connected to the car body 90 by bolts, similar to the front end portion 100. The front end of the portion 500 is not curved or protruded as portion 100, but is perpendicular.

The number of the shock absorbers 400 can be less than the number of shock absorbers disposed at the front end portion. Since the energy to be absorbed differs according to the position in the car body in which the shock absorbers are disposed, the number of shock absorbers is determined correspondingly. For example, the shock absorber 400 can only have an upper layer, or the cross-sectional area of the hollow members 210 constituting the shock absorber (the area composed of the cross-sectional area of the face plates 211, 212 and the connecting plates 213, 215) can be varied according to position. The shock absorbers provided to the middle cars disposed near the center of the railway car formation are designed to have smaller number of members and smaller cross-sectional area compared to the shock absorber 200 provided to the front end 100. The above explanation refers to the relation between the leading car and the middle car, but even when comparing the shock absorbers 400 provided to the plural middle cars, the shock absorber 400 disposed to the middle cars nearer to the center of the railway car formation has smaller number of members and smaller cross-sectional area than the shock absorber 400 of the middle cars located farther from the center of the railway car formation.

There is no member provided to the end portion 500 for connecting the coupler 70, similar to the front end portion 100. When collision occurs, the coupler 70 drops off so that the shock absorber 400 can exert its shock absorbing function. Moreover, the end portion 500 is not equipped with any strengthening member corresponding to the hollow members constituting the side sills of the underframe 30. The lower end of the plates constituting the outer surfaces of the end portion 500 covers the side surfaces of the shock absorber 400. However, the area of the end portion 500 receiving load from the entrance 510 and the like is equipped with members for supporting this load at the floor. These members collapse simultaneously when the shock absorbers 400 collapse. The floor of the passenger entrance 510 and the like is also supported by the shock absorbers 400.

The end portions 500 can include soft side sills. Such soft side sills can be prepared by annealing or punching appropriate holes to the members. The front end portion 100 and the end portion 500 are formed separately from the car body 90 in the above embodiment, but they can also be formed integrally with the car body 90. The hollow members 210 can be softened by having holes provided thereto at predetermined intervals, or by having formed to have appropriate plate thickness. According to other aspects of the invention, the construction of a generally known shock absorber can be applied as the shock absorber of the present invention.

The technical scope of the present invention is not limited to the terms used in the claims or in the summary of the present invention, but is extended for example to modifications that can be envisioned by those skilled in the art based on the present disclosure.

The present invention provides a railway car that is capable of absorbing the impact energy caused by collision, thereby ensuring safety.

What is claimed is:

1. A railway car body, wherein members constituting the ends of the car body in the direction of travel are shock absorbers;

each shock absorber is composed of plural extruded members having plural hollow portions;

said plural extruded members are disposed so that their extrusion directions correspond to the longitudinal direction of the car body, adjacent extruded members in a width direction of the railway car body being welded to each other by a friction stir weld, formed by performing friction stir welding along the longitudinal direction of the car body corresponding to a direction of impact;

a partition plate is disposed between two extruded members positioned adjacent to one another in the direction of extrusion of the members; and longitudinal ends of said two extruded members are welded to said partition plate.

2. A railway car body according to claim 1, wherein the thickness of said extruded members in the thickness direction is smaller than the size of said partition plate in the same direction; and the longitudinal ends of said extruded members are fixed to said partition plate by fillet welding.

3. A railway car body according to claim 1, wherein said plural extruded members are arranged vertically in multilayers; and the longitudinal end of the extruded member on the upper layer and the longitudinal end of the extruded member on the lower layer are both welded onto said partition plate.

4. A railway car body according to claim 1, wherein the length of said extruded member disposed in front of said partition plate is longer than the length of said extruded member disposed in the rear of said partition plate.

5. A railway car body according to claim 4, wherein a cross-sectional area of said extruded member disposed in front of the partition plate is smaller than a cross-sectional area of said extruded member disposed in the rear of the partition plate.

6. A railway car body according to claim 1, wherein said partition plate is sandwiched by said two extruded members in the direction of extrusion of the members, the partition plate having two main surfaces opposed to each other and the two extruded members respectively extending from the two main surfaces.

7. A railway car body according to claim 1, wherein material of the extruded members forming the shock absorbers is softer than material forming an underframe of the railway car body.

8. A railway car body according to claim 1, wherein the extruded members have a length in the longitudinal direction of at most 600 mm.

9. A railway car body according to claim 1, further comprising plates at respective ends of said members.

10. A railway car body according to claim 9, wherein each extruded member has face plates and connecting plates therebetween, and wherein ends of the face plates are welded to the plates at the respective ends of said members.

11. A railway car body, wherein members constituting the ends of the car body in the direction of travel are shock absorbers;

each shock absorber is composed of plural extruded members having plural hollow portions;

each extruded member comprises two face plates substantially parallel to one another and plural connecting plates that are connected to said face plates;

said plural extruded members are disposed so that their extrusion directions correspond to the longitudinal direction of the car body, adjacent extruded members in a width direction of the railway car body being welded to each other by a friction stir weld, formed by performing friction stir welding along the longitudinal direction of the car body corresponding to a direction of impact; and a plate is provided to one end of each extruded member in the width direction to which said two face plates are welded.

12. A railway car body according to claim 11, wherein the thickness of said extruded members in the thickness direction is smaller than the size of said plate in the same direction; and the longitudinal ends of said extruded members are fixed to said plate by fillet welding.

13. A railway car body according to claim 11, wherein said plural extruded members are arranged vertically in multilayers; and at least one end of the extruded member on the upper layer and at least one end of the extruded member on the lower layer are both welded onto said plate.

14. A railway car body according to claim 11, wherein each shock absorber includes at least four extruded members disposed in quadrilateral arrangement in the cross-section orthogonal to the longitudinal direction of said shock absorber, and said two face plates disposed at one end of said extruded member in the width direction are welded to the face plate of the extruded member disposed substantially orthogonal thereto.

15. A railway car body according to claim 11, wherein material of the extruded members forming the shock absorbers is softer than material forming an underframe of the railway car body.

16. A railway car body according to claim 11, wherein the extruded members have a length in the longitudinal direction of at most 600 mm.

* * * * *